US006032597A

United States Patent [19]

Inagaki

[11] Patent Number: 6,032,597

[45] Date of Patent: Mar. 7, 2000

[54] SHUTTLE HOOK DRIVER FOR SEWING MACHINE

[75] Inventor: Hidetaka Inagaki, Nagoya, Japan

[73] Assignee: Brother Kogyo Kabushiki Kaisha, Nagoya, Japan

[21] Appl. No.: 09/162,153

[22] Filed: Sep. 29, 1998

[30] Foreign Application Priority Data

Sep. 30, 1997 [JP] Japan ..... 9-284321
May 21, 1998 [JP] Japan ..... 10-139754

[51] Int. Cl.[7] ..... D05B 57/30; D05B 57/12

[52] U.S. Cl. ..... 112/220; 112/192

[58] Field of Search ..... 112/220, 183, 112/181, 182, 192, 194, 228, 232, 234

[56] References Cited

U.S. PATENT DOCUMENTS

| | | | |
|---|---|---|---|
| 1,062,696 | 5/1913 | Cox | 112/181 |
| 2,325,467 | 7/1943 | Beyer | 112/192 |
| 2,718,861 | 9/1955 | Samuels | 112/220 |
| 3,420,200 | 1/1969 | Johnson | 112/220 X |
| 3,587,495 | 6/1971 | Johnson | 112/220 X |
| 3,954,070 | 5/1976 | Papajewski | 112/182 |
| 5,549,061 | 8/1996 | Oda et al. | 112/220 |

FOREIGN PATENT DOCUMENTS

| | | |
|---|---|---|
| U-61-67681 | 5/1986 | Japan . |
| 63-11194 | 1/1988 | Japan . |
| B2-2-2684661 | 8/1997 | Japan . |

*Primary Examiner*—Ismael Izaguirre
*Attorney, Agent, or Firm*—Oliff & Berridge, PLC

[57] ABSTRACT

A shuttle hook driver for a sewing machine includes a driving pulley mounted on a main shaft, a driven pulley rotatable about a second shaft substantially crossing the shaft center of the main shaft and extending horizontally, a timing belt extending between the driving and driven pulleys and twisted approximately 90 degrees, and a converting mechanism for converting rotation of the driven pulley to reciprocation of the shuttle hook.

26 Claims, 8 Drawing Sheets

LEFTWARD

SHUTTLE HOOK DRIVER FOR SEWING MACHINE

BACKGROUND OF THE INVENTION

1. Field of the Invention

This invention relates to a shuttle hook driver provided in sewing machines for reciprocating a shuttle hook linked to a full turn main shaft, and more particularly to such a shuttle hook driver reciprocating the shuttle hook about a horizontal shaft crossing a shaft center of the main shaft.

2. Description of the Related Art

In sewing machines, a main shaft is generally driven by a sewing machine motor so that a needle bar and a thread loop taker both linked to the main shaft are driven. A sewing needle is attached to a lower end of the needle bar. Upon drive of the needle bar and the thread loop taker, a needle thread having passed through an eye of the needle is caught by a loop seizing beak of the thread loop taker so that the needle thread is entangled with the bobbin thread, whereby a stitch is formed.

Shuttle hooks have widely been used as the above-mentioned thread loop taker. The shuttle hook is reciprocated about a horizontal shaft crossing a shaft center of the main shaft. The prior art has provided various types of drivers for driving the shuttle hook. FIG. 10 illustrates one of the conventional shuttle hook drivers. As shown, a body 100 of the sewing machine includes an arm 100*a* and a sewing bed 100*b*. A main shaft 102 extending leftward and rightward as viewed in FIG. 10 is provided in the arm 100*a*. A shuttle hook 110 is provided in the bed 100*b* to be reciprocated about a horizontal shaft crossing the center of rotation of the main shaft 102. A shuttle hook driver 101 comprises a cam 103 fitted with the main shaft 102 to be fixed thereto, a driven member 104 moved in a cam groove 103*a* of the cam 103, a link member 105 supported on the sewing machine body 100 via a shaft 105*a* having a distal end to which the driven member 104 is secured, a pinion 106 fixed to the shuttle hook 110, a rack member 108 having a rack 107 meshed with the pinion 106 and a left-hand end urged downward by a spring 120, and a horizontal arm 109 extending rightward from the rack member 108 and having a right-hand end rotatably connected to a lower end of the link member 105.

Upon drive of the main shaft 102 and the cam 103 by a sewing machine motor (not shown) in the direction of arrow A, the driven member 104 is moved in the cam groove 103*a* in the above-described shuttle hook driver 101. The link member 105 is then rocked about the shaft 105*a* so that the rack member 108 is reciprocated rightward and leftward together with the horizontal arm 109. As a result, the shuttle hook 110 is reciprocated about the horizontal shaft.

A needle bar 115 including a sewing needle 116 is provided on a left-hand end of the arm 100*a*. A crank 118 is secured on the left-hand end of the main shaft 102. A rocking member 119 is rotatably connected both to the needle bar 115 and to the crank 118. Accordingly, upon drive of the main shaft 102, its rotation is transmitted via the crank 118 and the rocking member 119 to the needle bar 115, so that the needle bar and accordingly, the needle 116 are reciprocated upward and downward. Japanese Laid-open Utility Model Registration Publication No. 61-67681 (1986) also discloses the construction similar to that shown in FIG. 10.

Japanese Patent No. 2684661 discloses another shuttle hook driver for sewing machines. The disclosed shuttle hook driver comprises a first gear fixed to a main shaft, a second gear rotatable about a horizontal shaft crossing the main shaft and meshed with the first gear in the crossing state, a first pulley provided in the bed of the body, a second pulley fixed to the shuttle hook, a timing belt extending between the first and second pulleys, and a crank mechanism including a vertically elongated rink member and converting rotation of the second gear to reciprocation of the first pulley.

Upon drive of the main shaft and the first gear by a sewing machine motor in the above-described shuttle hook driver, the first pulley is reciprocally rotated via the second gear and the link member. The reciprocation of the first pulley is transmitted via the timing belt to the second pulley, whereby the shuttle hook is reciprocated.

Japanese Laid-open Patent Publication No. 63-11194 (1985) discloses a shuttle hook driver for a belt-driven sewing machine. The disclosed shuttle hook driver comprises a driving pulley connected via a drive belt to an output shaft of a sewing machine motor, a first driven pulley for drive of a needle bar, a second driven pulley for drive of the shuttle hook, a timing belt extending between the driving pulley and the first and second driven pulleys, a plurality of idle pulleys guiding the timing belt, a pinion fixed to the shuttle hook, a rack member including a rack meshed with the pinion, and a crank mechanism for converting rotation of the second driven pulley to reciprocation of the rack member.

In the above-described shuttle hook driver, the second driven pulley is rotated via the timing belt upon drive of the sewing machine motor. The rack member is reciprocated by the crank mechanism. Consequently, the shuttle hook is reciprocated about the horizontal shaft via the rack and pinion.

The above-described conventional shuttle hook drivers have the following problems. In the shuttle hook driver 101 shown in FIG. 10, the rotation of the main shaft 102 is converted by the cam 103, the link member 105, etc. to the reciprocation. In this case, it is technically difficult to engage the driven member 104 provided on the link member 105 with the cam groove 103*a* of the cam 103 without gap therebetween. However, when engaging the cam groove 103*a* with some gap therebetween, the driven member 104 collides with an inner surface of the cam groove 103*a* during operation of the sewing machine, thereby producing a loud noise. Furthermore, the cam groove 103*a* needs to be accurately formed in the cam 103 so that the vertical movement of the needle 116 or the needle bar 115 is synchronized with the reciprocation of the shuttle hook 110. This results in an increase in the manufacturing cost of the sewing machine.

The link member 105 transmitting the driving force is vertically long. Accordingly, the link member 105 needs to be made of a material with high strength so as not to suffer an elastic deformation during operation of the sewing machine, and more particularly during a high speed operation thereof. This also increases the manufacturing cost of the sewing machine. Generally, vibration tends to occur when a full turn member is disposed in an upper interior of the sewing machine body. In the above-described conventional construction, the cam 103, which is a full turn member, is disposed in an upper interior of the body. Moreover, the cam 103 rocks the vertically long link member 105. As a result, the vibration increases during the operation of the sewing machine.

In Japanese Patent No. 2684661, the first and second gears transmit the rotation of the main shaft to the horizontal shaft crossing the main shaft. Rotation of the horizontal shaft is then converted by the link member to reciprocation. Transmitting the driving force by the use of a plurality of gears reduces a transmission efficiency. Furthermore, the rotation of the second gear delays relative to the rotation of the first gear when the first and second gears are not in an accurate mesh engagement with each other.

Also, in Japanese Patent No. 2684661, full turn members, that is, the first and second gears are disposed in the upper interior of the body, and the rotation is converted to the reciprocation via the vertically long link member by the second gear. This results in the same technical problem as that described above concerning the shuttle hook driver shown in FIG. 10.

In Japanese Laid-open Patent Publication No. 63-11194, the timing belt is long so as to require a plurality of idle pulleys guiding it. This complicates the construction of the shuttle hook driver. The long timing belt further results in a difficulty in an adjustment for the vertical movement of the needle bar in synchronism with the reciprocation of the shuttle hook.

SUMMARY OF THE INVENTION

Therefore, an object of the present invention is to provide a shuttle hook driver for the sewing machine which can reduce the noise and vibration produced during operation of the sewing machine, and which can be simplified in the construction for reduction in the manufacturing cost.

Another object of the invention is to provide a shuttle hook driver for the sewing machine in which the shuttle hook can be operated accurately in synchronism with the vertical movement of the sewing needle.

The present invention provides a shuttle hook driver for a sewing machine which includes a shuttle hook reciprocated about a first shaft substantially crossing a shaft center of a main shaft of the sewing machine and extending horizontally, the shuttle hook being linked to the main shaft so as to be driven in synchronism with rotation of the main shaft. The driver comprises a driving pulley provided on the main shaft, a driven pulley rotatable about a second shaft substantially crossing the shaft center of the main shaft and extending horizontally, and a timing belt extending between the driving and driven pulleys and twisted approximately 90 degrees. A converting mechanism is provided for converting rotation of the driven pulley to reciprocation of the shuttle hook.

According to the above-described construction, the rotation of the main shaft is converted via the driving and driven pulleys and the timing belt extending these pulleys to the reciprocation about the horizontal shaft substantially crossing the center of rotation of the main shaft. Consequently, the construction of the driver can be simplified as compared with the case where a cam or gears are used for the motion converting purpose. Furthermore, the vibration and noise produced during the operation of the sewing machine can be reduced.

In a preferred form, the converting mechanism includes a crank mechanism. Furthermore, the converting mechanism preferably includes a first pulley rotatable about a shaft in parallel with the second shaft, a second pulley provided on the shuttle hook, a shuttle hook driving timing belt extending between the first and second pulleys, and a crank mechanism converting the rotation of the driven pulley to the reciprocation of the first pulley. In this construction, the rotation of the main shaft is converted via the two timing belts and the crank mechanism to the reciprocation of the shuttle hook. Consequently, the shuttle hook can readily be reciprocated accurately in synchronism with the vertical movement of the needle bar. In this case, a further reduction in the vibration during the operation can be achieved when a sewing bed located relatively lower in the sewing machine body accommodates the shuttle hook, the driven pulley, the first pulley and the crank mechanism.

In another preferred form, the crank mechanism includes a crank lever provided on the driven pulley and a link member having one of two ends thereof rotatably connected to a portion of the crank lever located near an outer circumference of the driven pulley and the other end rotatably connected to a portion of the first pulley located near an outer circumference thereof. In this construction, a distance from said one end of the link member to a center of rotation of the driven pulley is preferably set so as to be shorter than a distance from said other end of the link member to a center of rotation of the first pulley. Consequently, the rotation of the driven pulley can reliably be converted to the reciprocation of the first pulley.

In further another preferred form, a distance from the driven pulley to the first pulley is set so as to be shorter than a distance from the first pulley to the second pulley. This construction can reduce the length of the crank mechanism and particularly that of the link member. Consequently, the strength of the link member need not be increased, and accordingly, the manufacturing cost can be reduced.

In further another preferred form, the converting mechanism includes a pinion provided on the shuttle hook, a rack member having a rack operatively meshing the pinion, and a crank mechanism converting rotation of the driven pulley to reciprocation of the rack member.

In further another preferred form, the timing belt is fed toward the driving pulley from a direction crossing a center of rotation of the driving pulley in a normal rotation of the main shaft. In this construction, the timing belt in engagement with the driving pulley is subjected to no force moving the belt in the direction in which the main shaft extends, during the normal rotation of the main shaft. Consequently, the timing belt can be prevented from being disengaged from the driving pulley.

The timing belt extending between the driving and driven pulleys is twisted about 90 degrees. Accordingly, when the timing belt is fed toward the driving pulley from the direction crossing the center of rotation of the driving pulley in the normal rotation of the main shaft, the timing belt is preferably fed from the driving pulley toward the driven pulley in a direction oblique relative to the direction crossing the center of rotation of the driving pulley in the normal rotation of the main shaft.

In further another preferred form, the shuttle hook driver further comprises a driving pulley guiding member guiding the driving pulley so that the timing belt is engaged with the driving pulley or a driven pulley guiding member guiding the driven pulley so that the timing belt is engaged with the driven pulley.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 1:
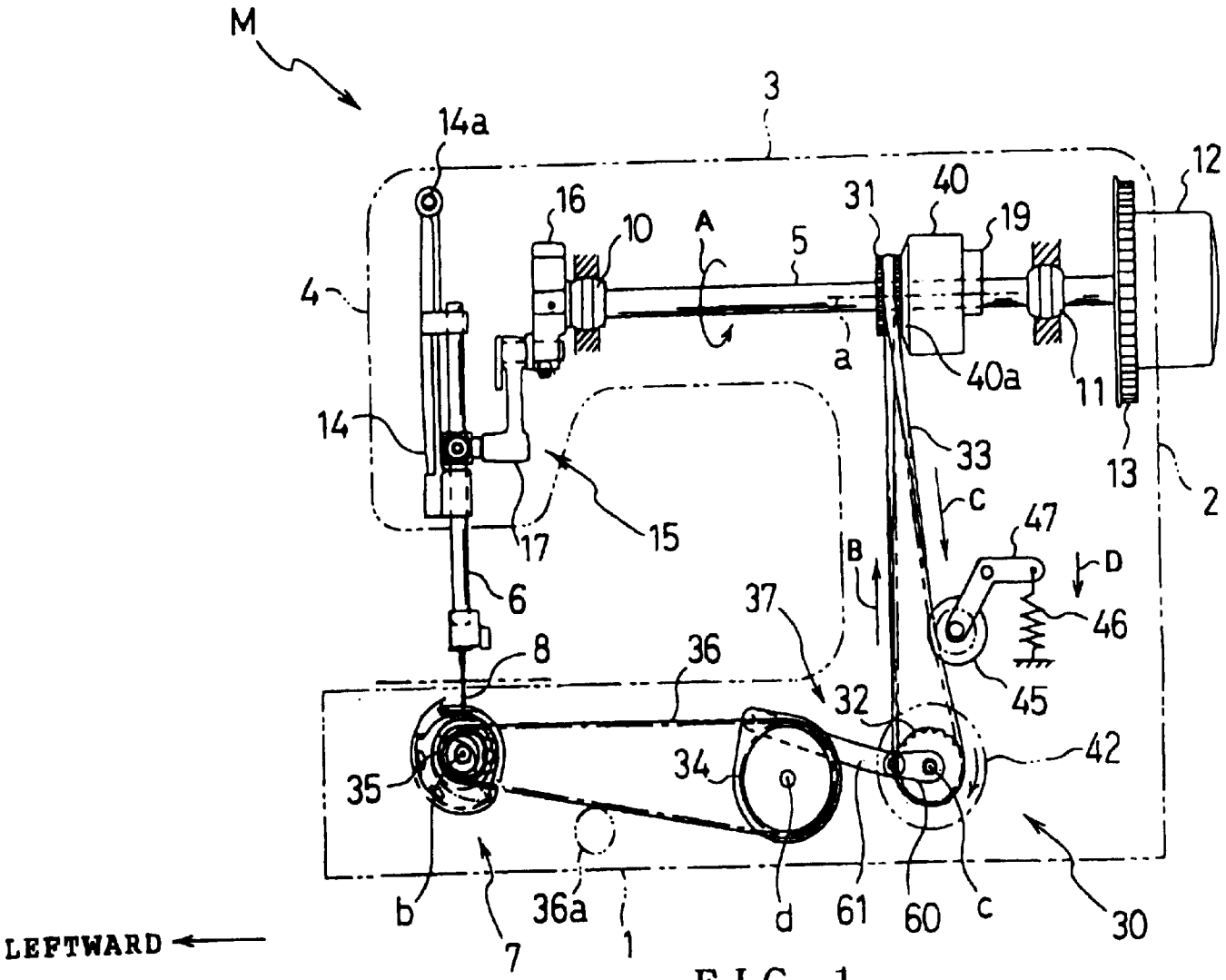
FIG. 1 is a front view of the shuttle hook driver of a first embodiment in accordance with the present invention.

A first embodiment of the present invention will be described with reference to FIGS. 1 to 6. Referring to FIG. 1, the shuttle hook driver in accordance with the invention is shown. A sewing machine body M comprises a horizontally extending sewing bed 1, a pillar 2 standing upward from the right-hand portion of the bed 1, and an arm 3 extending horizontally from the upper portion of the pillar 2 so as to be opposite the bed 1. The arm 3 encloses a main shaft 5 extending rightward and leftward. The main shaft 5 is rotatably supported on bearings 10 and 11. A needle bar 6 is mounted in a left-hand end or head 4 of the arm 3 for vertical movement and rightward and leftward rocking movement. A sewing needle 8 is detachably attached to a lower end of the needle bar 6. A shuttle hook 7 is provided in a left-hand interior of the bed 1. The shuttle hook 7 is rotated normally and reversely, namely, reciprocated about a shaft center b of a first shaft crossing a shaft center a of the main shaft 5 and horizontally extending frontward and backward.

A needle bar driving mechanism 15 is provided in the body M for vertically moving the needle bar 6 in synchronization with the main shaft 5. A shuttle hook driving mechanism 30 is also provided in the body M for reciprocating the shuttle hook 7 about the shaft center b in synchronization with the main shaft 5. The body M further accommodates therein a needle bar rocking mechanism for rocking the needle bar 6 rightward and leftward, a feed dog, a feed dog driving mechanism, a feed amount adjusting mechanism for adjusting an amount of feed of the feed dog, and a presser foot as well known in the art, although these are not shown.

A rotary operation member 12 and a pulley 13 formed integrally with the operation member 12 are secured to a right-hand end of the main shaft 5. The operation member 12 protrudes through a right-hand side of the pillar 2. The pulley 13 is driven by a sewing machine motor (not shown). A crank 16 of the needle bar driving mechanism 15 is secured to a left-hand end of the main shaft 5. A needle bar holder 14 is provided in the head 4. An upper end of the needle bar holder 14 is mounted on a shaft 14*a*. The needle bar 6 is supported on the holder 14 for vertical movement. A rocking member 17 is provided between the crank 16 and the needle bar 6. The rocking member 17 has both ends connected to the crank 16 and the needle bar 6 respectively. Upon rotation of the main shaft 5, the needle bar 6 is vertically reciprocated via the crank 16 and the rocking member 17 at a predetermined stroke.

A driving pulley 31 is fitted with a portion of the main shaft 5 located between the bearings 10 and 11 and screwed thereto, for example. A driven pulley 32 is rotatably mounted in the bed 1 so as to be located below the driving pulley 31. The driven pulley 32 crosses the shaft center a of the main shaft 5 and is rotatable about a second shaft center c parallel with the shaft center b of the shuttle hook 7. A first timing belt 33 extends between the driving and driven pulleys 31 and 32. The first timing belt 33 is twisted 90 degrees.

A first pulley 34 is rotatably mounted in the bed 1 so as to be located between the driven pulley 32 and the shuttle hook 7. The pulley 34 is rotatable about a shaft center d parallel with the shaft center c of the driven pulley 32. The pulley 34 is disposed so that a distance between the pulley 34 and the driven pulley 32 is shorter than a distance between the pulley 34 and the shuttle hook 7. A crank mechanism 37 is provided between the driven pulley 32 and the first pulley 34 for converting rotation of the driven pulley 32 to reciprocation, namely, normal and reverse rotation of the first pulley 34. A second pulley 35 is fixed to the shuttle hook 7 so as to be rotated normally and reversely together with the shuttle hook. A second timing belt 36 extends between the first and second pulleys 34 and 35. The second timing belt 36 serves as a shuttle hook driving timing belt. Thus, the shuttle hook driver 30 comprises the driving and driven pulleys 31 and 32, the first and second timing belts 33 and 36, the first and second pulleys 34 and 35, and the crank mechanism 37.

Figure 3:
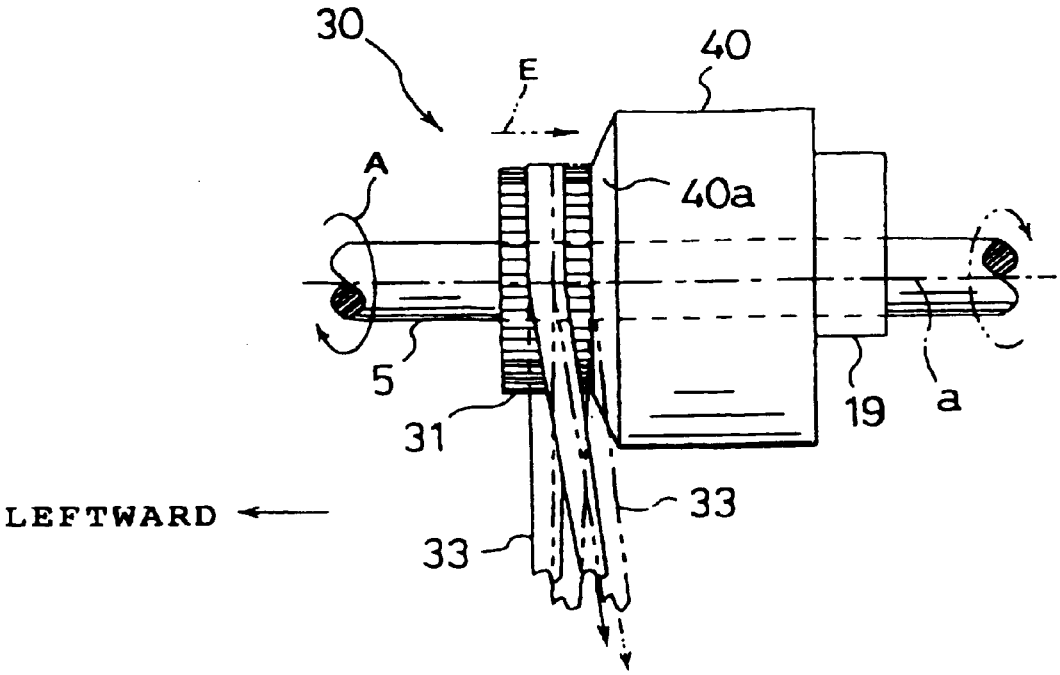
FIG. 3 shows the directions in which the timing belt engages and disengages from the driving pulley.

The shuttle hook driver 30 will now be described in detail. Referring to FIG. 3, the driving pulley 31 has a width three times as large as a width of the first timing belt 33. A guide 40 is provided on the right-hand end of the driving pulley 31. The guide 40 has a larger diameter than the driving pulley 31 and is formed with a tapered face 40a on a left-hand end thereof. When the guide 40 moves the first timing belt 33 in a direction of arrow E, the right-hand end of the timing belt 33 slides on the tapered face 40*a* such that the timing belt is returned to the driving pulley 31. A feed cam 19 for the feed dog driving mechanism is formed integrally with a right-hand end of the guide 40.

Figure 4:
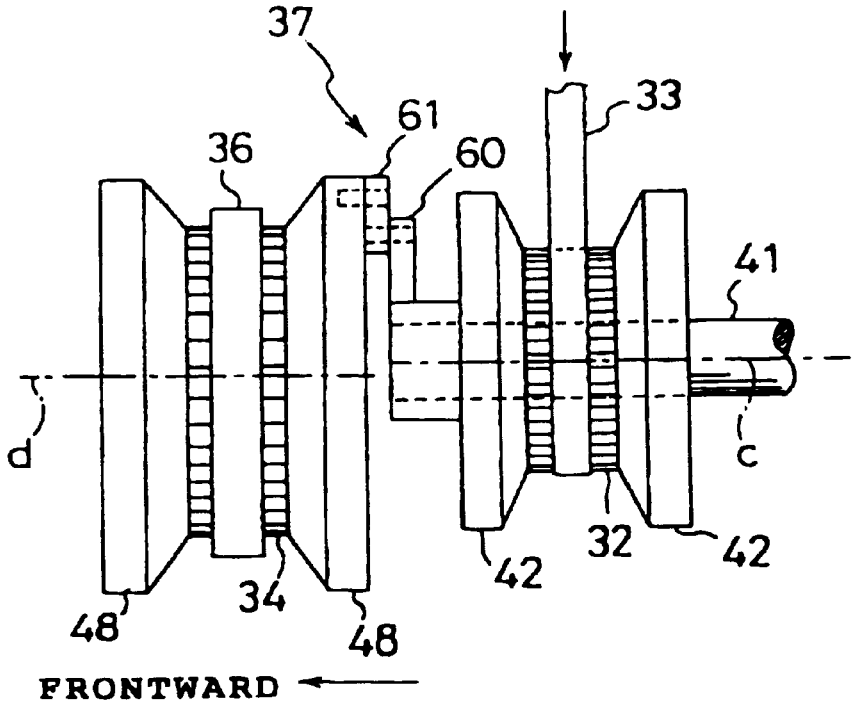
FIG. 4 is a right-hand side view of the driven pulley and the first pulley.
Figure 5:
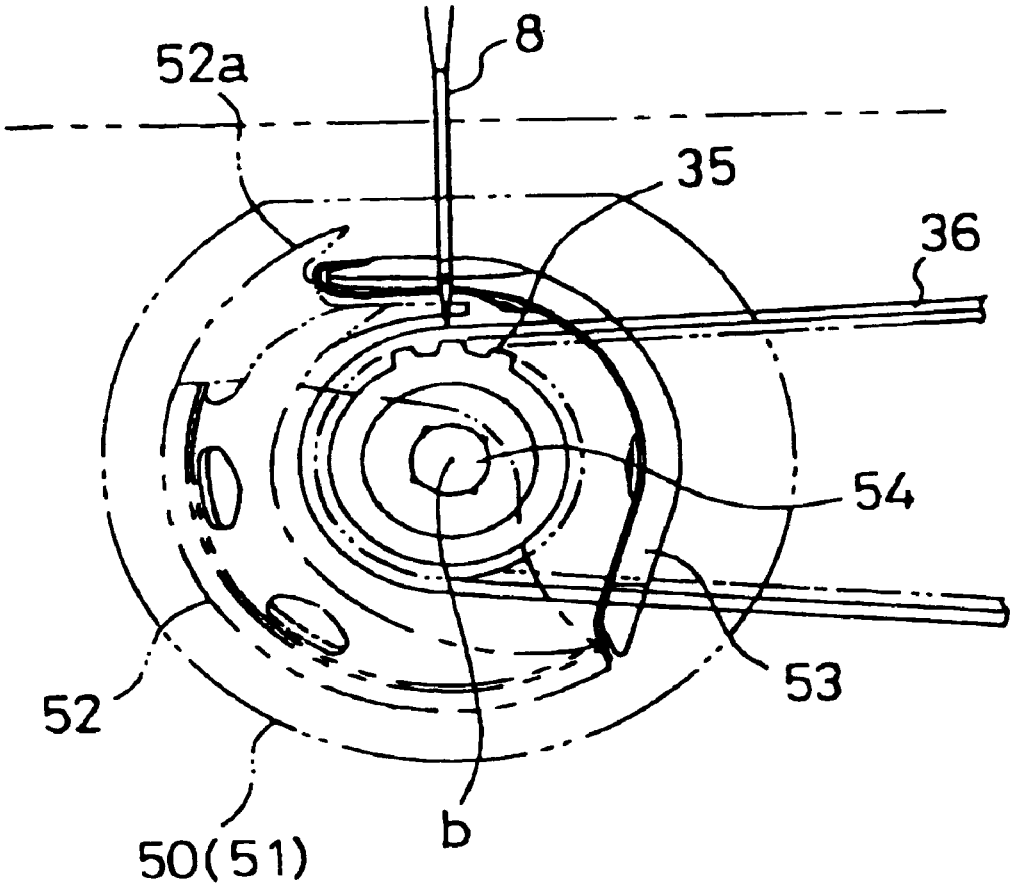
FIG. 5 is a front view of the shuttle hook.
Figure 6:
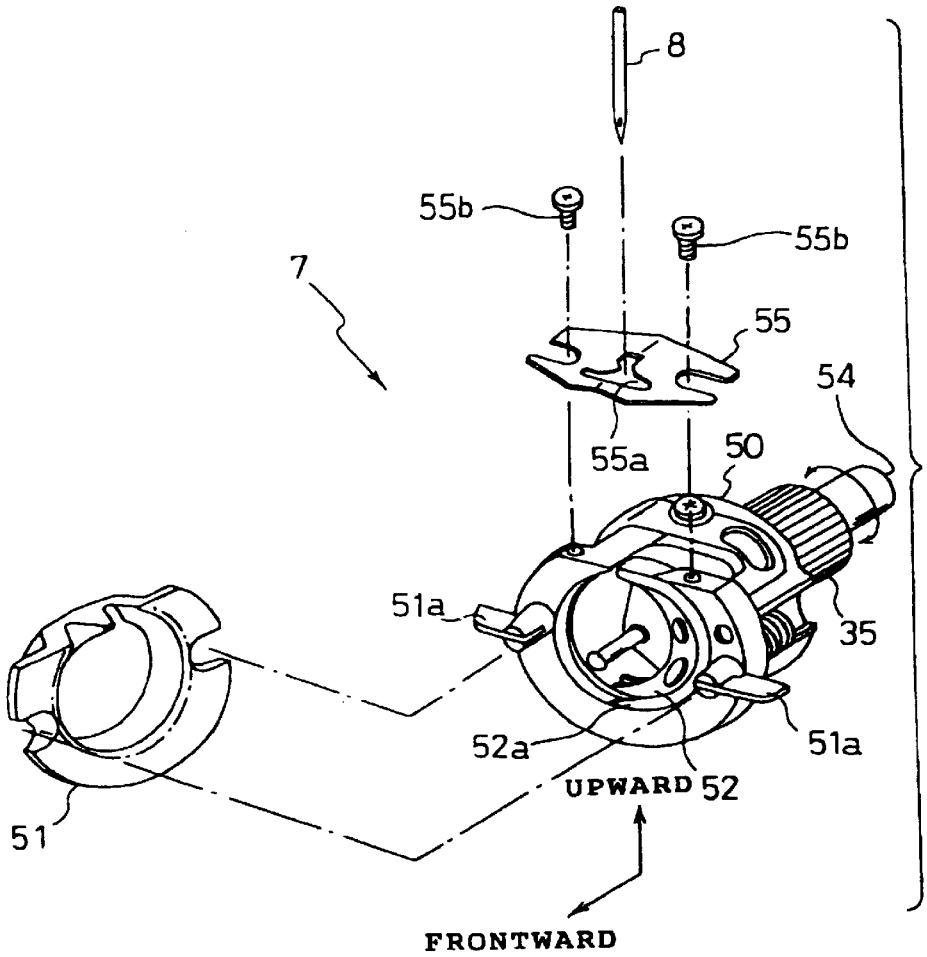
FIG. 6 is a partially exploded perspective view of the shuttle hook.

Referring to FIG. 4, the driven pulley 32 is mounted on a support shaft 41 and has a width about three times as large as that of the first timing belt 33. A pair of guides 42 are provided on both ends of the driven pulley 32 for guiding the first timing belt 33 so that the belt engages the driven pulley 32. A crank lever 60 extends radially from the shaft center c. A proximal end of the crank lever 60 is secured to a front end of the forwardly located guide 42.

Figure 2:
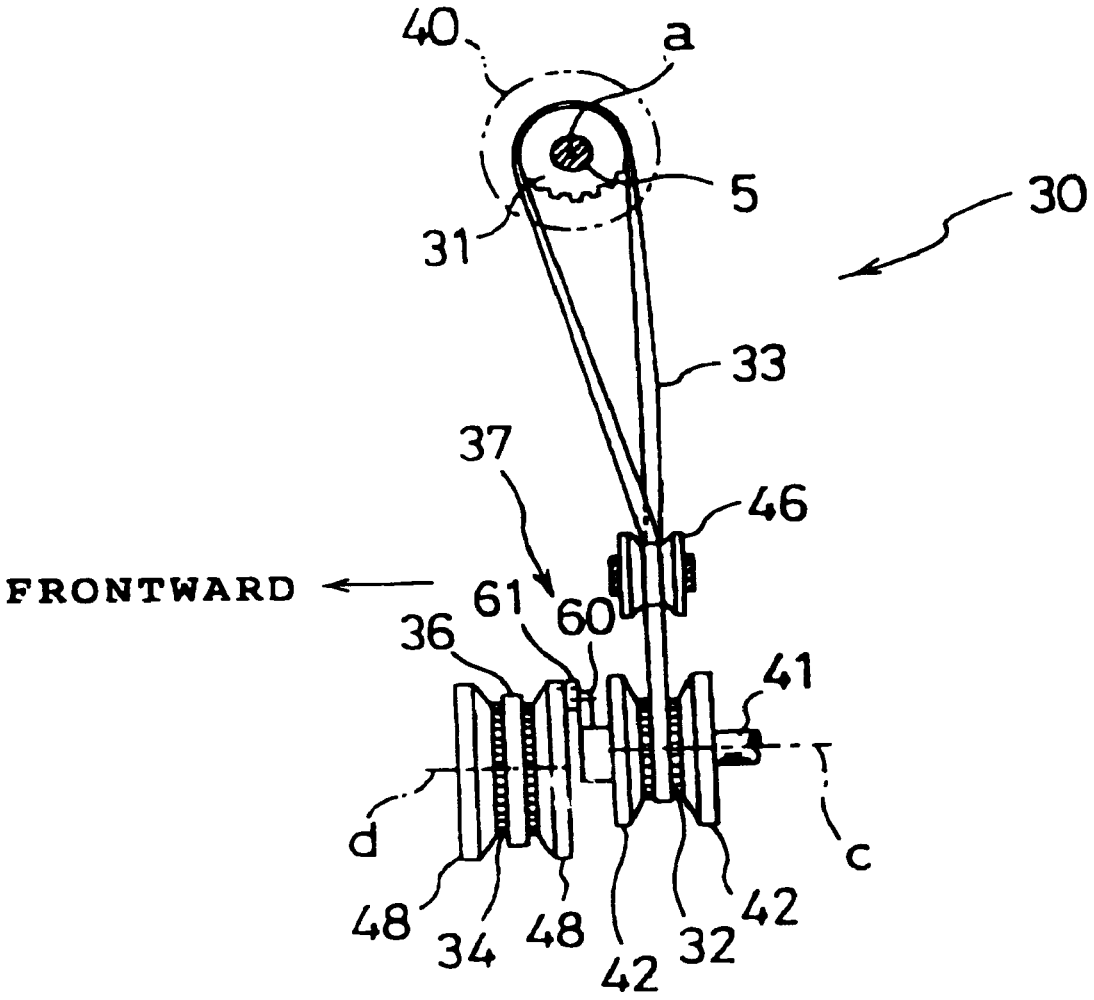
FIG. 2 is a right-hand side view of the driving pulley, the driven pulley and the first pulley of the shuttle hook driver.

The driving and driven pulleys 31 and 32 are disposed so that the left-hand end of the driven pulley 32 is located below the rear end of the driving pulley 32, as shown in FIGS. 1 and 2. Consequently, during the normal rotation of the main shaft 5 or rotation thereof in the direction of arrow A, the first timing belt 33 is fed toward the driving pulley 31 from a direction crossing the shaft center a of the driving pulley 31 and further fed from the driving pulley 31 in a direction oblique relative to a direction crossing the shaft center a as shown by arrow C in FIG. 1.

Turning to FIG. 1, an idle pulley 45 is provided between the driving and driven pulleys 31 and 32. The idle pulley 45 is rotatably mounted on the body M. More specifically, a spring member 46 is connected at one of two ends thereof to a proximal end of a link member 47 and at the other end to the body M. The idle pulley 45 is rotatably mounted on a distal end of the link member 47. The idle pulley 45 abuts, from the right-hand side, the first timing belt 33 being fed in the direction of arrow C during the normal rotation of the main shaft 5, thereby applying tension to the timing belt. Furthermore, the idle pulley 45 feeds the timing belt 33 toward the driven pulley 32 from the direction crossing the shaft center c of the driven pulley 32, as shown in FIG. 2.

Referring to FIG. 4, the first pulley 34 has a width about three times as large as that of the second timing belt 36. The first pulley 34 has a pair of guides 48 respectively formed on front and rear ends thereof for guiding the second timing belt 36. One end of a link member 61 is rotatably connected to an outer circumferential edge of a rear end face of the rear guide 48. The other end of the link member 61 is rotatably connected to the distal end of the crank lever 60 as shown in FIGS. 1, 2 and 4. The crank lever 60 and the link member 61 constitute a crank mechanism 37. A length of the crank lever 60 or a distance between the shaft center c and the distal end of the crank lever 60 is set to be shorter than a distance between the one end of the link member 61 and the shaft center d of the first pulley 34. As the result of this setting, rotation of the driven pulley 32 is reliably converted to the reciprocation of the first pulley 34.

The shuttle hook 7 comprises a shuttle race body 50 fixed in the bed 1 and a generally annular shuttle race 51 detachably attached to the front of the shuttle race body 50 by a pair of fittings 51*a*. The shuttle hook 7 further comprises a shuttle body 52 incorporated in the shuttle race body 50 and the shuttle race 51, a driver 53 for driving the shuttle body 52, and a drive shaft 54 of the driver 53. The second pulley 35 is provided integrally on the rear portion of the drive shaft 54.

A loop seizing beak 52*a* is formed on one end of the front side of the shuttle body 52. The beak 52*a* catches a needle thread extending through the eye of the needle 8, forming a loop. The beak 52*a* further enlarges the needle thread loop. A shuttle thread guide plate 55 having a hole 55*a* is fixed by two small screws 55*b* to upper faces of the shuttle race body 50 and the shuttle race 51. The needle thread loop caught and expanded is separated by the shuttle thread guide plate 55 into a front portion and a rear portion.

Another idle pulley 36*a* (shown by two-dot chain line in FIG. 1) is provided between the first and second pulleys 34 and 35. The idle pulley 36*a* is urged upward by a spring-member (not shown). The idle pulley 36*a* abuts the backside of the second timing belt 36 located between the lower ends of the first and second pulleys 34 and 35, thereby applying tension to the belt.

The operation of the shuttle hook driver 30 will now be described. The driven pulley 32 is rotated via the first timing belt 33 clockwise when the sewing machine motor is rotated normally to rotate the main shaft 5 and the driving pulley 31 in the direction of arrow A. The crank lever 60 is then rotated together with the driven pulley 32 to thereby rock the link member 61. As a result, the first pulley 34 is rotated normally and reversely about the shaft center d of the first pulley 34. The normal and reverse rotation of the first pulley 34 is transmitted via the second timing belt 36 to the second pulley 35 so that the shuttle hook 7 is rotated normally and reversely about the shaft center b. At this time, the first timing belt 33 engages the driving pulley 31 from the direction crossing the shaft center a as shown in FIG. 3. Accordingly, the first timing belt 33 is subjected to almost no force moving it leftward nor rightward such that the engagement of the timing belt with the driving pulley 31 is maintained.

On the other hand, when the user operates the rotary operation member 12 so that the main shaft 5 is rotated reversely or in the direction opposite arrow A, the timing belt 33 engages the driving pulley 31 from the direction slightly rightwardly oblique relative to the direction crossing the shaft center a, as viewed in FIG. 3. Accordingly, the timing belt 33 is subjected to a force moving it in a direction of arrow E. When moved in the direction of arrow E, the timing belt 33 abuts the guide 40 to thereby be returned to the driving pulley 31 side by the tapered face 40*a*. Thus, the timing belt 33 is prevented from being separated or disengaged from the driving pulley 31.

According to the above-described embodiment, a relatively simpler construction including the driving pulley 31, the first timing belt 33 and the driven pulley 32 is provided for converting the rotation of the main shaft 5 rotated about the shaft center a to the rotation of the driven pulley 32 rotated about the horizontal shaft center c crossing the shaft center a. Consequently, the manufacturing cost can be reduced as compared with the case where a cam or gears are used, and the noise produced during the operation of the sewing machine can also be reduced. Moreover, since the driven pulley 32 is disposed in the bed 1 in the embodiment, the vibration and noise produced during the operation of the sewing machine can further be reduced.

The distance between first and second pulleys 34 and 35 is shorter than the distance between the first and driven pulleys 34 and 32. This reduces the size of the crank mechanism 37 converting the rotation of the driven pulley 32 to the reciprocation of the first pulley 34. Since particularly the length of the link member 61 is reduced, the strength thereof need not be increased. Consequently, the manufacturing cost can further be reduced. Furthermore, both of the driven pulley 32 and the first pulley 34 are disposed in the bed 1. Consequently, since the crank mechanism 37 is also disposed in the bed 1, a further reduction in the vibration and noise can be achieved.

Figure 10:
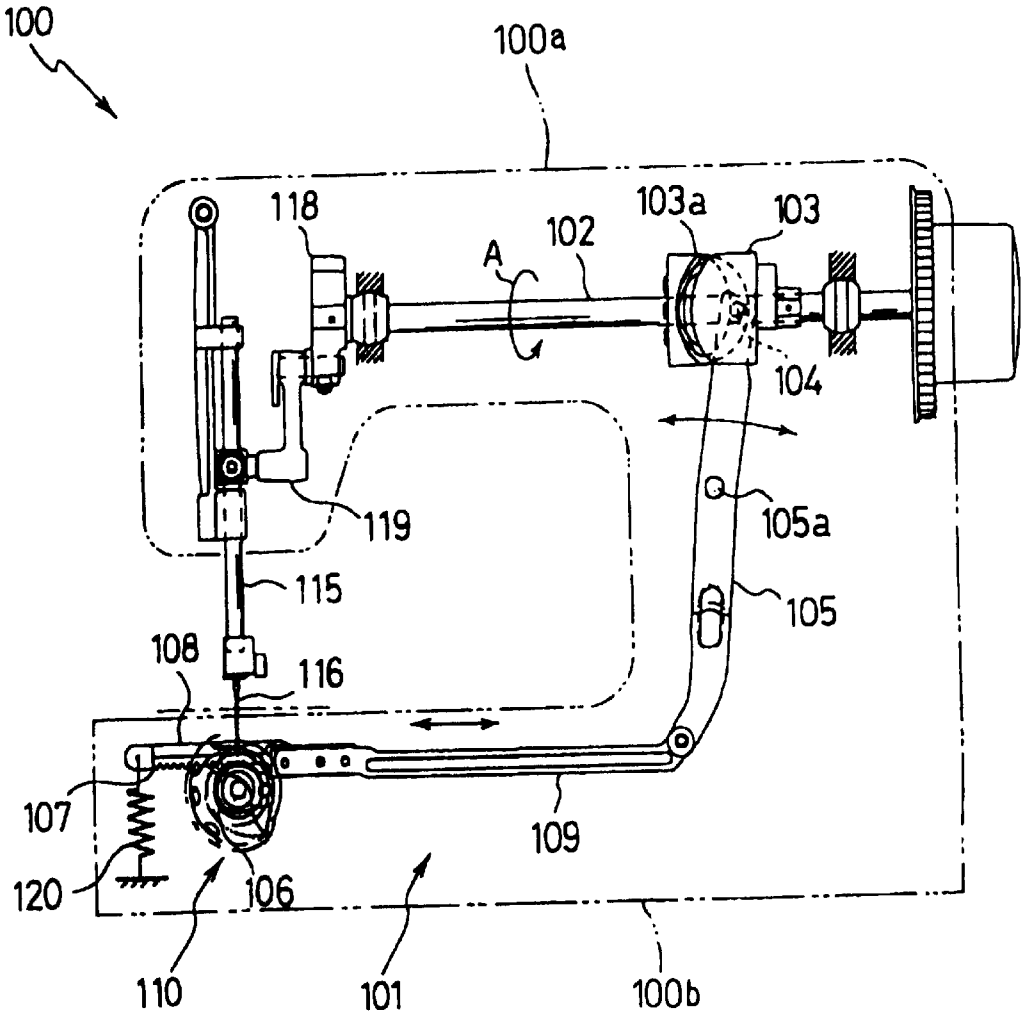
FIG. 10 PRIOR ART
FIG. 10 is a front view of a conventional shuttle hook driver.

The normal and reverse rotation of the first pulley 34 is transmitted via the second timing belt 36 to the shuttle hook 7 in the foregoing embodiment. More specifically, the timing belt 36 is carried normally and reversely between the first and second pulleys 34 and 35 during the operation of the sewing machine. The timing belt 36 is not moved to the left of the shuttle hook 7. In the prior art as shown in FIG. 10, the bed 100*b* needs to be extended leftward over the shuttle hook 110 for the movement of the rack member 108. In the above-described embodiment, however, the length of the bed 1 can be reduced as compared with the above-described prior art construction. This can reduce the size of the sewing machine.

The timing belts 33 and 36, and the crank mechanism 37 are provided for converting the rotation of the main shaft 5 to the reciprocation of the shuttle hook 7 in the foregoing embodiment. Consequently, the vertical movement of the needle bar 6 can readily be synchronized with the reciprocation of the shuttle hook 7.

Figure 7:
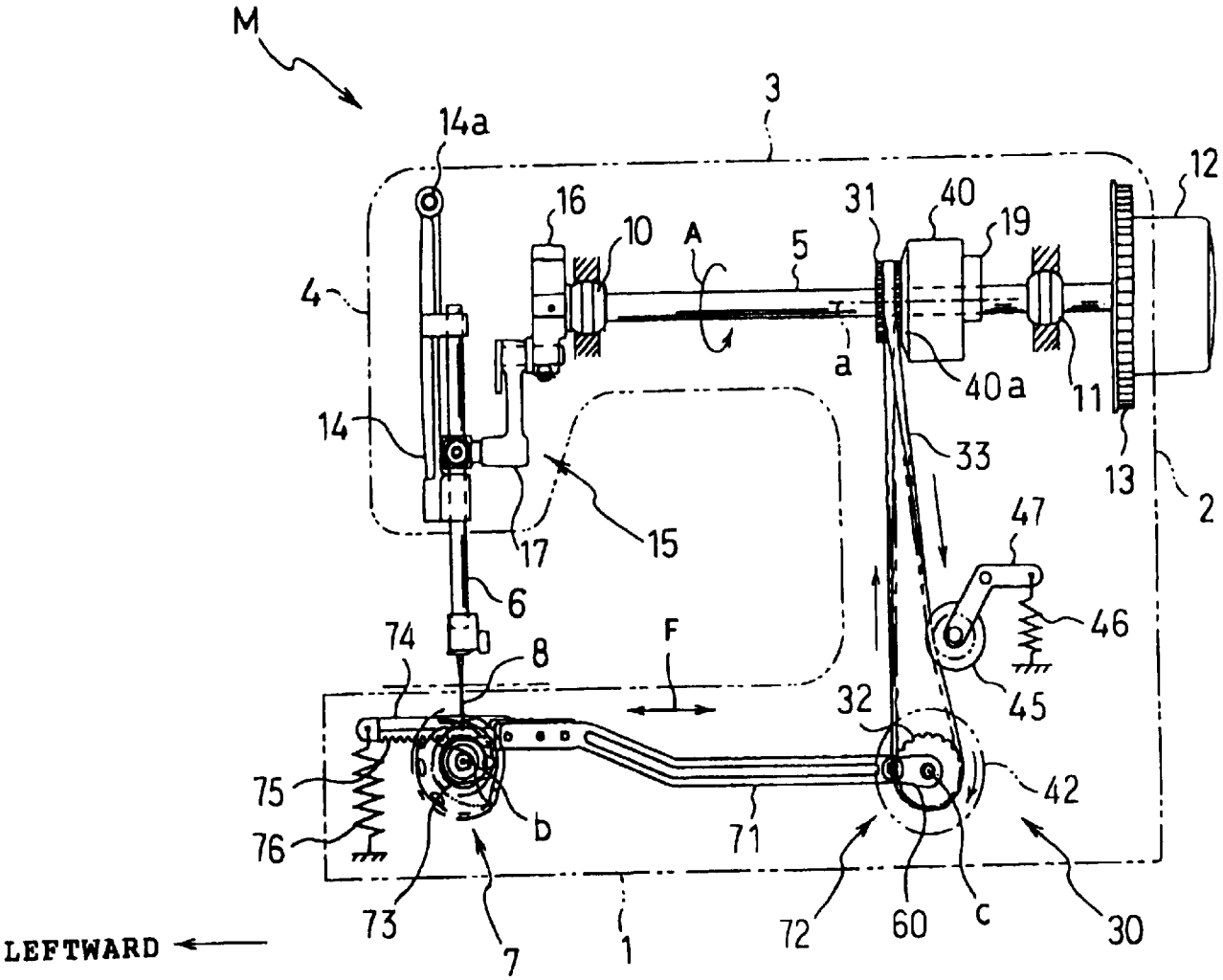
FIG. 7 is a front view of the shuttle hook driver of a second embodiment in accordance with the invention.
Figure 8:
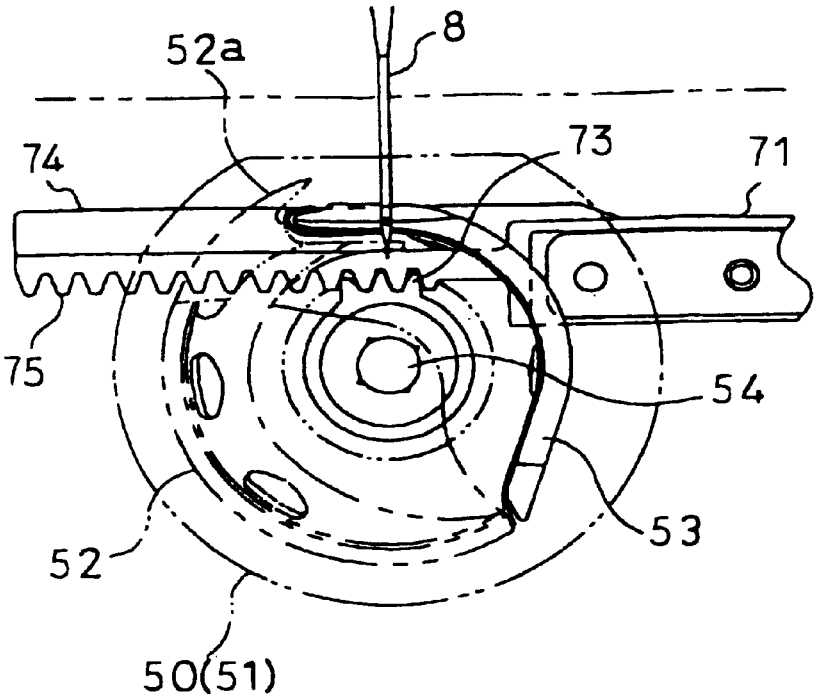
FIG. 8 is a front view of the shuttle hook.

FIGS. 7 and 8 illustrate a second embodiment of the invention. Differences between the first and second embodiments will be described. Identical or similar parts in the second embodiment are labeled by the same reference symbols as in the first embodiment. The second embodiment differs from the first embodiment in the construction for converting the rotation of the driven pulley 32 to the reciprocation of the shuttle hook 7. A horizontal arm 71 is provided between the driven pulley 32 and the shuttle hook 7 as shown in FIG. 7. The horizontal arm 71 has a right-hand end rotatably connected to the distal end of the crank lever 60 secured to the driven pulley 32. The horizontal arm 71 and the crank lever 60 constitute a crank mechanism 72.

Referring to FIG. 8, a pinion 73 is integrally provided on the rear portion of the driving shaft 54 of the shuttle hook 7, instead of the second pulley 35 (see FIG. 1). The horizontal arm 71 has a left-hand end to which a rack member 74 is fixed. A rack 75 is formed on the lower end of the rack member 74 so as to mesh the pinion 73. A spring member 76 urges a right-hand end of the rack member 74 downward so that the rack 75 reliably meshes the pinion 73. In the second embodiment, the shuttle hook driver 30 thus comprises the driving pulley 31, the driven pulley 32, the timing belt 33, the crank mechanism 72, the pinion 73, and the rack member 74.

In the above-described construction, the horizontal arm 71 and the rack member 74 are reciprocated leftward and rightward or in the direction of arrow F in FIG. 7 when the main shaft 5 is rotated normally to thereby rotate the driven pulley 32 clockwise. The reciprocation of the rack member 74 is transmitted via the rack 75 to the pinion 73, whereby the shuttle hook 7 is rotated normally and reversely about the shaft center b. Accordingly, in the second embodiment, too, the rotation of the driven pulley 32 is converted to the reciprocation of the shuttle hook 7 by a relatively simpler construction including the crank mechanism 72, the pinion 73 and the rack member 74. Furthermore, the arm 71 constituting the crank mechanism 72 and the driven pulley 32 rotated full turn to reciprocate the arm 71 leftward and rightward are disposed in the bed 1. Consequently, the vibration can be reduced during the operation of the sewing machine. The other construction of the shuttle hook driver in the second embodiment is the same as that in the first embodiment. Accordingly, substantially the same effect can be achieved from the second embodiment as from the first embodiment.

Figure 9:
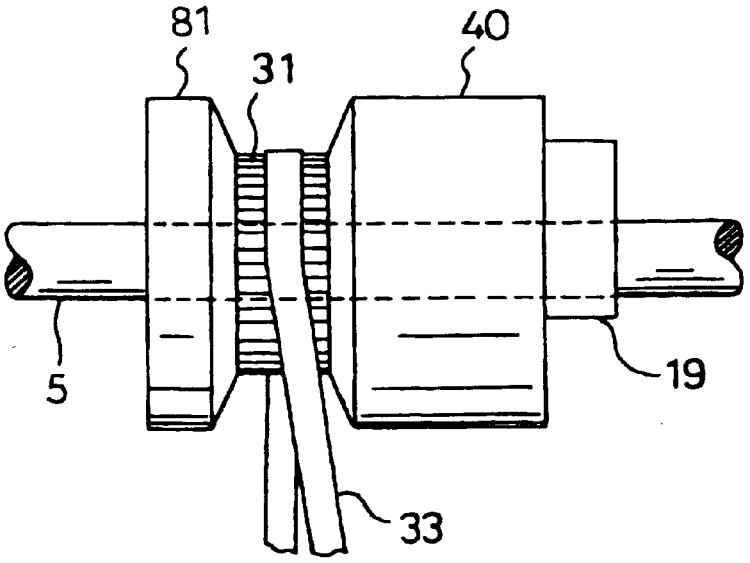
FIG. 9 is a front view of the driving pulley employed in the shuttle hook driver of a third embodiment in accordance with the invention.

The present invention should not be limited to the foregoing embodiments. A guide 81 may also be provided on the left-hand end of the driving pulley 31 as shown as a third embodiment in FIG. 9. In the third embodiment, the timing belt 33 can more reliably be prevented from the disengagement from the driving pulley 31. Furthermore, the guide preventing the timing belt 33 from the disengagement from the pulleys 31 and 32 may be disposed to be far away from these pulleys.

The timing belt 33 engages the driven pulley 32 from the direction crossing the shaft center C. Thus, the timing belt 33 is prevented from disengaging from the driven pulley 32. Accordingly, the guide member 42 may be eliminated when the width of the driven pulley 32 is increased to some extent. In this case, the idle pulley 45 serves a guide for the driven pulley 32.

A rack member with a rack may be provided instead of the link member 61 provided between the crank lever 60 and the first pulley 34 in the first embodiment. In this case, when a pinion the rack meshes is provided on the first pulley, a crank mechanism can be provided for converting the rotation of the driven pulley to the reciprocation of the first pulley.

The foregoing description and drawings are merely illustrative of the principles of the present invention and are not to be construed in a limiting sense. Various changes and modification will become apparent to those of the ordinary skill in the art. All such changes and modifications are seen to fall within the scope of the present invention as defined by the appended claims.

I claim:

1. A shuttle hook driver for a sewing machine which includes a shuttle hook reciprocated about a first shaft substantially crossing a shaft center of a main shaft of the sewing machine and extending horizontally, the shuttle hook being linked to the main shaft so as to be driven in synchronism with rotation of the main shaft, the driver comprising:

a driving pulley provided on the main shaft;

a driven pulley rotatable about a second shaft substantially crossing the shaft center of the main shaft and extending horizontally;

a timing belt extending between the driving and driven pulleys and twisted approximately 90 degrees; and a converting mechanism for converting rotation of the driven pulley to reciprocation of the shuttle hook.

2. A shuttle hook driver according to claim 1, wherein the converting mechanism includes a crank mechanism.

3. A shuttle hook driver according to claim 2, wherein the timing belt is fed toward the driving pulley from a direction crossing a center of rotation of the driving pulley in a normal rotation of the main shaft.

4. A shuttle hook driver according to claim 3, wherein the timing belt is fed from the driving pulley toward the driven pulley in a direction oblique relative to a direction crossing a center of rotation of the driving pulley in a normal rotation of the main shaft.

5. A shuttle hook driver according to claim 4, further comprising a driving pulley guiding member guiding the driving pulley so that the timing belt is engaged with the driving pulley.

6. A shuttle hook driver according to claim 4, further comprising a driven pulley guiding member guiding the driven pulley so that the timing belt is engaged with the driven pulley.

7. A shuttle hook driver according to claim 1, wherein the converting mechanism includes:

a first pulley rotatable about a shaft in parallel with the second shaft;

a second pulley provided on the shuttle hook;

a shuttle hook driving timing belt extending between the first and second pulleys; and a crank mechanism converting the rotation of the driven pulley to the reciprocation of the first pulley.

8. A shuttle hook driver according to claims 7, wherein the sewing machine includes a body further including a sewing bed accommodating the shuttle hook, the driven pulley, the first pulley and the crank mechanism.

9. A shuttle hook driver according to claim 8, wherein the crank mechanism includes a crank lever provided on the driven pulley and a link member having one of two ends thereof rotatably connected to a portion of the crank lever located near an outer circumference of the driven pulley and the other end rotatably connected to a portion of the first pulley located near an outer circumference thereof.

10. A shuttle hook driver according to claim 9, wherein a distance from said one end of the link member to a center of rotation of the driven pulley is set so as to be shorter than a distance from said other end of the link member to a center of rotation of the first pulley.

11. A shuttle hook driver according to claim 10, wherein a distance from the driven pulley to the first pulley is set so as to be shorter than a distance from the first pulley to the second pulley.

12. A shuttle hook driver according to claim 9, wherein a distance from the driven pulley to the first pulley is set so as to be shorter than a distance from the first pulley to the second pulley.

13. A shuttle hook driver according to claim 7, wherein the timing belt is fed toward the driving pulley from a direction crossing a center of rotation of the driving pulley in a normal rotation of the main shaft.

14. A shuttle hook driver according to claim 13, wherein the timing belt is fed from the driving pulley toward the driven pulley in a direction oblique relative to a direction crossing a center of rotation of the driving pulley in a normal rotation of the main shaft.

15. A shuttle hook driver according to claim 14, further comprising a driving pulley guiding member guiding the driving pulley so that the timing belt is engaged with the driving pulley.

16. A shuttle hook driver according to claim 14, further comprising a driven pulley guiding member guiding the driven pulley so that the timing belt is engaged with the driven pulley.

17. A shuttle hook driver according to claim 1, wherein the converting mechanism includes:

a pinion provided on the shuttle hook;

a rack member having a rack operatively meshing the pinion; and a crank mechanism converting the rotation of the driven pulley to reciprocation of the rack member.

18. A shuttle hook driver according to claim 17, wherein the timing belt is fed toward the driving pulley from a direction crossing a center of rotation of the driving pulley in a normal rotation of the main shaft.

19. A shuttle hook driver according to claim 18, wherein the timing belt is fed from the driving pulley in a direction oblique relative to a direction crossing a center of rotation of the driving pulley in a normal rotation of the main shaft.

20. A shuttle hook driver according to claim 19, further comprising a driving pulley guiding member guiding the driving pulley so that the timing belt is engaged with the driving pulley.

21. A shuttle hook driver according to claim 19, further comprising a driven pulley guiding member guiding the driven pulley so that the timing belt is engaged with the driven pulley.

22. A shuttle hook driver according to claim 1, wherein the timing belt is fed toward the driving pulley from a direction crossing a center of rotation of the driving pulley in a normal rotation of the main shaft.

23. A shuttle hook driver according to claim 22, wherein the timing belt is fed from the driving pulley toward the driven pulley in a direction oblique relative to a direction crossing a center of rotation of the driving pulley in a normal rotation of the main shaft.

24. A shuttle hook driver according to claim 23, further comprising a driving pulley guiding member guiding the driving pulley so that the timing belt is engaged with the driving pulley.

25. A shuttle hook driver according to claim 23, further comprising a driven pulley guiding member guiding the driven pulley so that the timing belt is engaged with the driven pulley.

26. A shuttle hook driver for a sewing machine which includes a shuttle hook reciprocated about a first shaft substantially crossing a shaft center of a main shaft of the sewing machine and extending horizontally, the shuttle hook being linked to the main shaft so as to be driven in synchronism with rotation of the main shaft, the driver comprising:

a timing belt means twisted approximately 90 degrees;

driving means fortdriving the timing belt;

rotating means driven by the timing belt to rotate about a second shaft substantially crossing the shaft center of the main shaft and extending horizontally; and converting means for converting rotation of the votating means to reciprocation of the shuttle hook.

* * * * *